US005351760A

United States Patent [19]

Tabor. Jr.

[11] Patent Number: 5,351,760

[45] Date of Patent: Oct. 4, 1994

[54] FIRE SUPPRESSION SYSTEM AND METHOD FOR ITS USE

[76] Inventor: Bernard E. Tabor. Jr., 2375 North Ave., Bridgeport, Conn. 06605

[21] Appl. No.: 931,726

[22] Filed: Aug. 18, 1992

[51] Int. Cl.[5] ..... A62C 3/00

[52] U.S. Cl. ..... 169/65; 169/70; 169/59

[58] Field of Search ..... 169/65, 54, 56, 59

[56] References Cited

U.S. PATENT DOCUMENTS

| | | | |
|---|---|---|---|
| 3,283,827 | 11/1966 | Diehl | 169/65 |
| 3,463,233 | 8/1969 | Haessler | 169/65 X |
| 3,653,443 | 4/1972 | Dockery . | |
| 3,773,111 | 11/1973 | Dunn | 169/26 |
| 3,866,687 | 2/1975 | Banner | 169/65 X |
| 3,889,754 | 6/1975 | Dunn | 169/59 |
| 3,889,757 | 6/1975 | Dunn | 169/59 |
| 3,897,828 | 8/1975 | Glover | 169/43 |
| 3,981,232 | 9/1976 | Williamson | 169/65 X |
| 4,085,735 | 4/1978 | Kaufman et al. | 169/65 X |
| 4,256,181 | 3/1981 | Searcy | 169/65 |
| 4,356,870 | 11/1982 | Gaylord et al. | 169/65 |
| 4,520,717 | 6/1985 | Bohrer, Jr. et al. | 169/65 X |
| 4,539,898 | 9/1985 | Bishop et al. | 99/336 |
| 4,675,541 | 6/1987 | Peters et al. | 169/65 X |
| 4,773,485 | 9/1988 | Silverman | 169/65 |
| 4,785,725 | 11/1988 | Tate et al. | 169/65 X |
| 4,813,487 | 3/1989 | Mikulec et al. | 169/65 |
| 4,830,116 | 5/1989 | Walden et al. | 169/65 |
| 4,834,188 | 5/1989 | Silverman | 169/65 |
| 4,979,572 | 12/1990 | Mikulec | 169/65 |

*Primary Examiner*—David M. Mitchell
*Assistant Examiner*—Gary C. Hoge
*Attorney, Agent, or Firm*—David P. Gordon

[57] ABSTRACT

A fire suppression system for use with a cookstove or range operates in several modes or stages to warn of, prevent, and extinguish stovetop fires. The system includes a pressurized supply of fire retardant connected to a nozzle. A fusible link releases the fire retardant through the nozzle. Several sensors are attached to a circuit so that increasing ambient temperature can be monitored. The supply of fire retardant is provided with a low pressure sensor which may be overridden. On sensing a first temperature increase, a fan is switched on. At a second temperature, an alarm is activated. At a third temperature, the stove is shut down. The fusible link is designed to melt at a temperature higher than the third temperature so that provisional measures may be activated prior to dispensing the fire retardant. Methods related to the fire suppression system are also disclosed.

21 Claims, 10 Drawing Sheets

POWER ON
902
PRESSURE DROP IN CANISTER
904
YES
NO
DOOR OPEN
906
YES
NO
GAS VALVE CLOSES ALARM SOUNDS FAN SHUTS OFF
908
LIGHT MAY BE TURNED ON FAN MAY BE TURNED ON
910
SET RESET SWITCH
912
YES
NO
GAS VALVE OPENS STOVE MAY BE USED
914
GAS VALVE CLOSED
916
160° SENSED
918
YES
FAN TURNS ON
920

FIRE SUPPRESSION SYSTEM AND METHOD FOR ITS USE

BACKGROUND OF THE INVENTION

1. Field of the Invention

The present invention relates to a fire suppression system for a cookstove or a range. In particular, the invention relates to an automatic self-contained fire suppression system which may be installed (retrofitted) in an existing hood over a cookstove or range or which may be constructed with its own hood for installation over a cookstove or range. The system is further described with reference to a particular method for its use.

2. The Prior Art

It is well known to place an exhaust hood over a cookstove or range. Such a hood usually contains a fan and in some cases contains fire suppression equipment.

Known fire suppression equipment used in hoods placed over cookstoves or ranges are disclosed in several prior U.S. patents. These prior patents disclose numerous arrangements for automatically extinguishing stove fires.

Early fire suppression systems for use with cook stoves and ranges were mainly concerned with delivering fire retardant onto the cooking surface to stop a fat or grease fire. The early systems did not include means for shutting down the stove and the exhaust fan, or activating an alarm.

U.S. Pat. No. 3,653,443 to Dockery, which is hereby incorporated by reference, discloses an improved fire suppression system which, in addition to releasing fire retardant, sounds an alarm, shuts down the stove and exhausts smoke. One of the disadvantages of the Dockery system is that it is not easily retro-fitted into existing hoods.

U.S. Pat. Nos. 4,773,485 and 4,834,188 to Silverman, which are hereby incorporated by reference, disclose a fire suppression system which is readily retro-fitted to existing stove hoods. Silverman's system is installed within and adjacent to the stove hood. That is, a portion of Silverman's system is fitted within an existing hood and another portion of Silverman's system is located adjacent to the existing hood and the two portions are connected by a series of conduits, wires and pulleys. A clear disadvantage of Silverman's system is that it is not self-contained. Although Silverman suggests that his system is readily retro-fitted to existing hoods, his system requires substantial modification to the existing hood. Holes must be drilled. Pulleys must be mounted to carry wires attached to fusible links. Nozzles attached to conduits must be mounted inside the hood and the conduits must extend through the existing hood to an external supply of fire retardant.

U.S. Pat. Nos. 4,813,487 and 4,979,572 to Mikulec, which are hereby incorporated by reference, disclose a system similar to Silverman's, but which does not require so much drilling and cutting of the existing hood. Mikulec's system provides most of the mechanical parts in a single piece which is mounted from the rear of an existing hood at a specified angle. This piece is also connected by wire to a device for shutting down the stove. One of the disadvantages of Mikulec's system is that there must be room for it behind the existing hood and the angle of mounting is limited. Moreover, Mikulec's system is limited in features, being essentially a fire extinguisher and a stove shut off switch. In addition, Mikulec's system leaves components exposed to direct heat, grease, and possible fire thereby compromising the operation of the system.

U.S. Pat. No. 4,830,116 to Walden et al., which is hereby incorporated by reference, discloses a fire suppression system where tanks containing fire suppression fluids are located remote from the hood. The system includes means for shutting down the stove, sounding an alarm and activating an exhaust fan. Walden's system is clearly not self-contained and is not easily retrofitted to existing hoods.

All of the known systems have particular disadvantages, some of which are mentioned above. No one of the known systems contains all of the features taught by all of the other systems. Also, while, most stove fires are the result of grease or fat, none of the known systems pays particular attention to the danger of splashing the grease or fat when fire retardant is sprayed through a nozzle over the stove. Unless the nozzles are properly positioned, the first spray of fire retardant may serve only to spread the burning fat or grease beyond the stove top. Moreover, cooking fat and grease always accumulates in the hood over the stove and can clog nozzles unless special measures are taken to prevent this. None of the known systems addresses this problem. Further, all of the known systems rely on a pressurized supply of fire retardant, but none of them provide any means for warning when the pressure is too low to be effective in releasing the supply of fire retardant. While two of the known systems (Silverman and Walden) provide a pressure sensing means at the supply of fire retardant, the pressure sensing means is used to sense release of the retardant and shut down the stove. None of the known systems contains a means for warning that the system may not operate properly because the pressure has dropped too low.

Finally, and perhaps most importantly, all of the prior art systems tend to act in only two modes: on or off. In other words, all of the features are activated simultaneously or automatically with a predetermined time delay or not at all. This assumes that all stove fires will require the same treatment and that no early warning or provisional measures can be used to avert a serious fire without engaging the full force of the suppression system. However, it should be appreciated that the release of fire retardant is a drastic step which should be used as a last resort.

SUMMARY OF THE INVENTION

It is therefore an object of the invention to provide means by which the fire suppression system may be activated in stages so that early warning alarms and appliance shutdown can prevent fires before they happen and fire retardant can be released only as a last resort.

It is a further object of the invention to provide a fire suppression system which can be easily retrofitted to an existing stove or range hood.

It is also an object of the invention to provide means for sounding an alarm, activating an exhaust fan, shutting down the stove and other appliances, and dispensing fire retardant onto the stove top or range.

It is another object of the invention to arrange nozzles for delivery of fire retardant so that grease or fat fires will not be splashed, and so that grease or fat accumulating in the hood will not clog the nozzles or allow fires to spread into duct work, into walls, or other cavities.

It is yet another object of the invention to provide warning means to sound an alarm when the system is inoperable due to low pressure.

In accord with these objects and others which will be discussed in detail below, the fire suppression system of the present invention broadly comprises, within a hood, at least one thermal detector for detecting a plurality of temperatures, an exhaust fan, an alarm, a relay means for shutting off gas or electricity to a stove, and a fire extinguisher system including a pressurized canister in a heat insulated portion of the hood, and at least one nozzle. The thermal detector(s) detect(s) when a first predetermined temperature has been reached above a stove or oven and is coupled to and activates the exhaust fan. The thermal detector(s) also detect(s) when a second predetermined temperature (typically indicative of a fire) has been reached and is coupled to and activates an alarm. The second predetermined temperature is also preferably used to activate the relay means to shut off the energy source of the stove or oven. Alternatively, the automatic shut-off may occur at a third predetermined temperature. Another thermal detector, preferably in the form of a fusible link is used to mechanically activate the extinguisher system should an even higher temperature be reached even after the fan has been turned on, the alarm sounded, and the energy source turned off. When the fire extinguisher system is activated, a fire retardant is sprayed from the protected canister through one or more strategically placed nozzles.

Additional preferred aspects of the system include the use of detachable nozzle caps which automatically release when fire retardant is sprayed, but which otherwise protect the nozzles from grease build-up, nozzles which are designed to spray in a conical mist to avoid splashing grease, and the provision of a pressure monitoring means coupled to the canister which activates an alarm and the stove shut-off when the pressure is below a predetermined threshold.

It will be appreciated that the fire prevention methods are directed to the apparatus of the invention.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
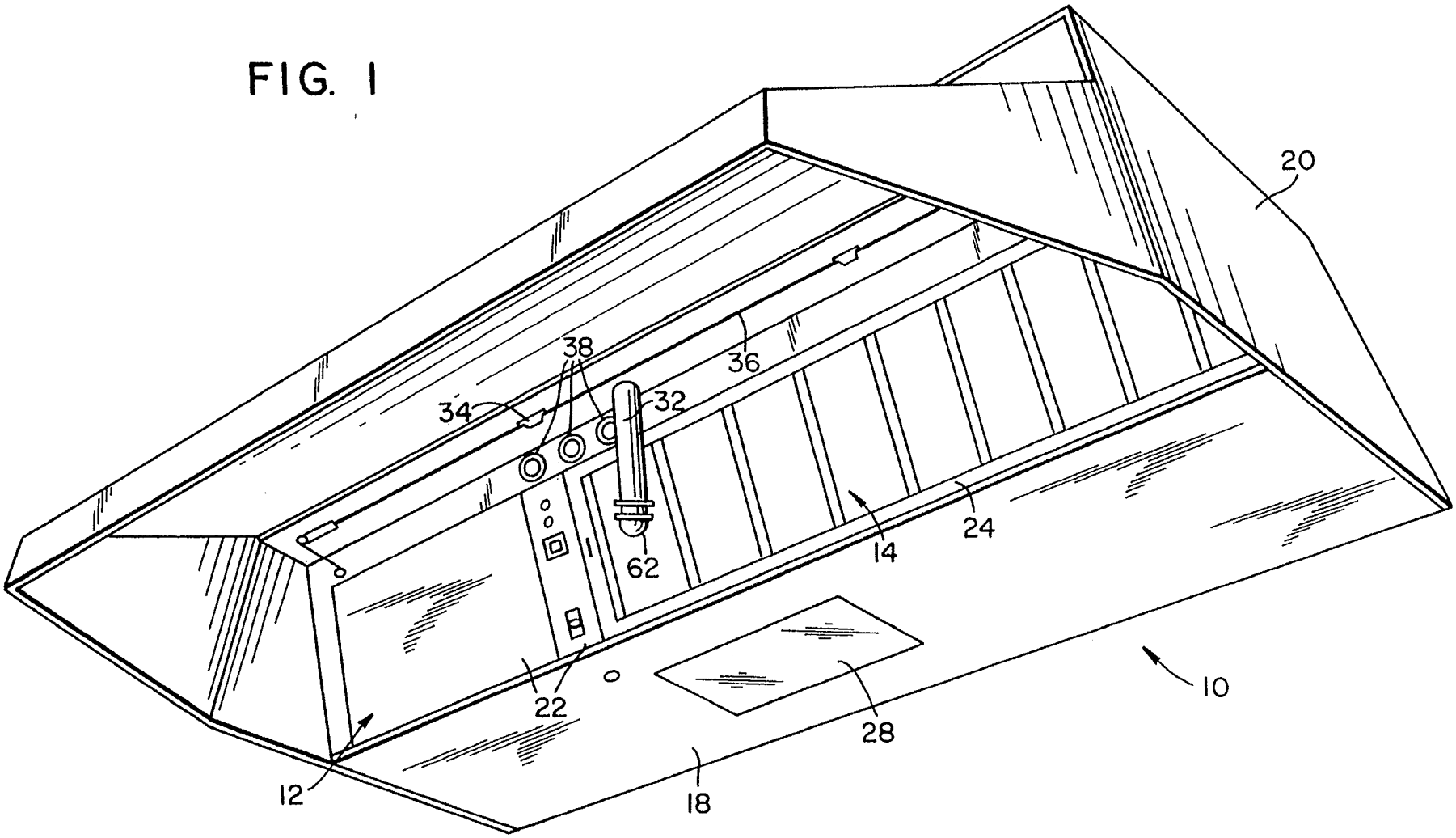
FIG. 1 is a perspective view of one embodiment of a fire suppression system fitted inside a hood.

Referring now to FIG. 1, the fire suppression system is shown generally as 10. FIG. 1 also shows an attached hood 20. As mentioned above, the fire suppression system 10 of the present invention is self-contained and may be fitted into an existing hood 20 or may be manufactured with an attached hood 20.

The fire suppression system 10 may be considered as having two sections, the fire control section 12 and another section 14 which may contain a fan, filters, lighting, ductwork and/or other components as will be discussed in detail below. In general, the fire control section 12 may be enclosed by removable thermal panels 22 and the other section 14 may be covered with a baffle style filter 24. Both sections 12 and 14 may be covered from below by a single bottom assembly 18 which may be provided with an opening or filter 28 for lighting which may be contained in section 14. The bottom assembly 18 may be hinged or connected in any other conventional way and panels 22 should stay in place when the bottom assembly is opened.

FIG. 1 also shows other portions of the fire suppression system such as nozzle assembly 32, fusible link 34, cable 36, and heat sensor(s) 38, all of which will be discussed in detail below.

Figure 2:
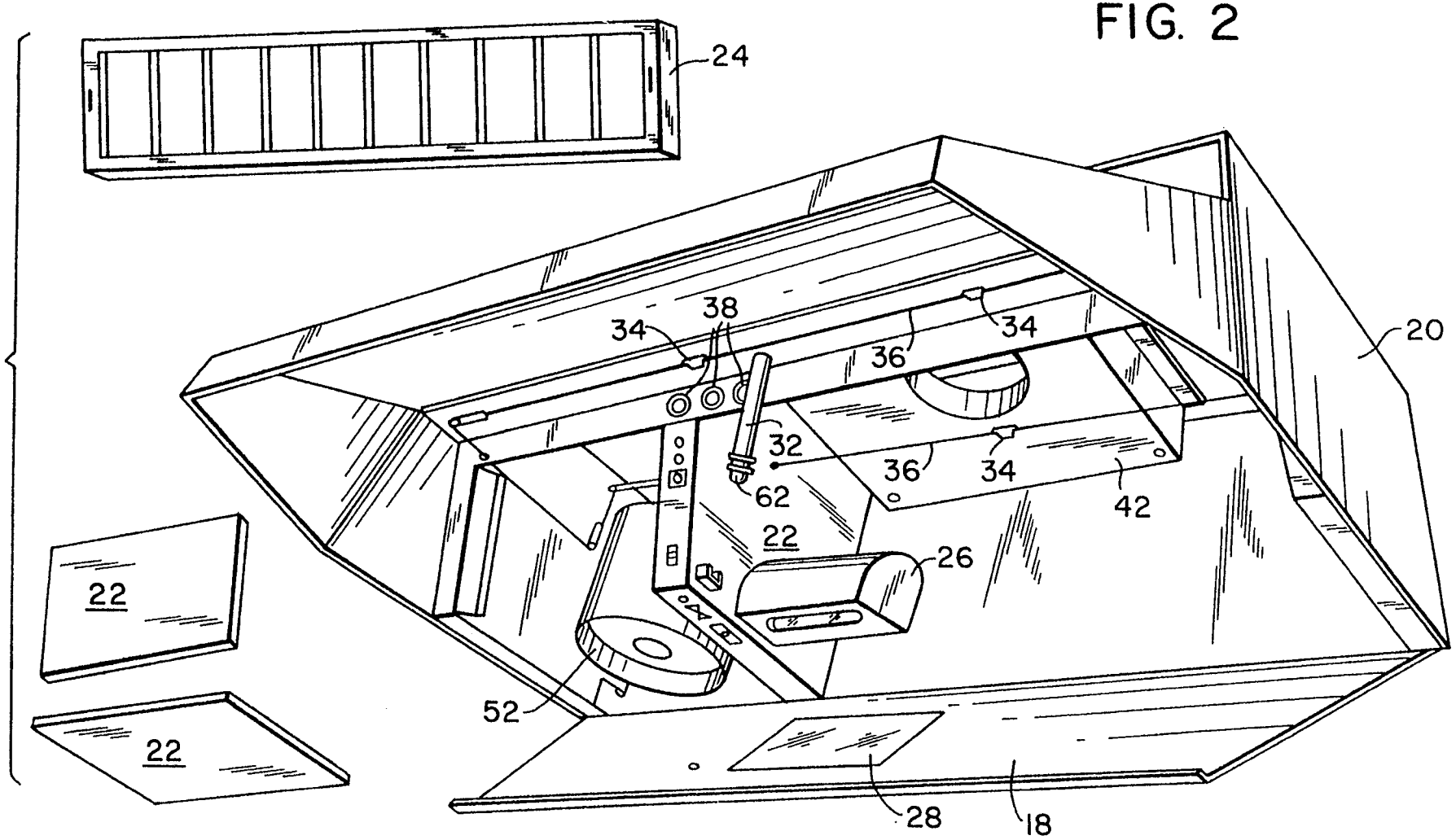
FIG. 2 is a view similar to FIG. 1, with some cover panels exploded to expose the interior of the system.

FIG. 2 shows the interior of the fire suppression system with bottom assembly 18 hinged and open, two thermal panels 22 removed exposing canister 52 containing fire retardant under pressure, and filter 24 removed exposing fan assembly 42 and a lighting enclosure 26. The thermal panels 22 provide excellent protection for the canister 52 against the heat due to fires.

Figure 3:
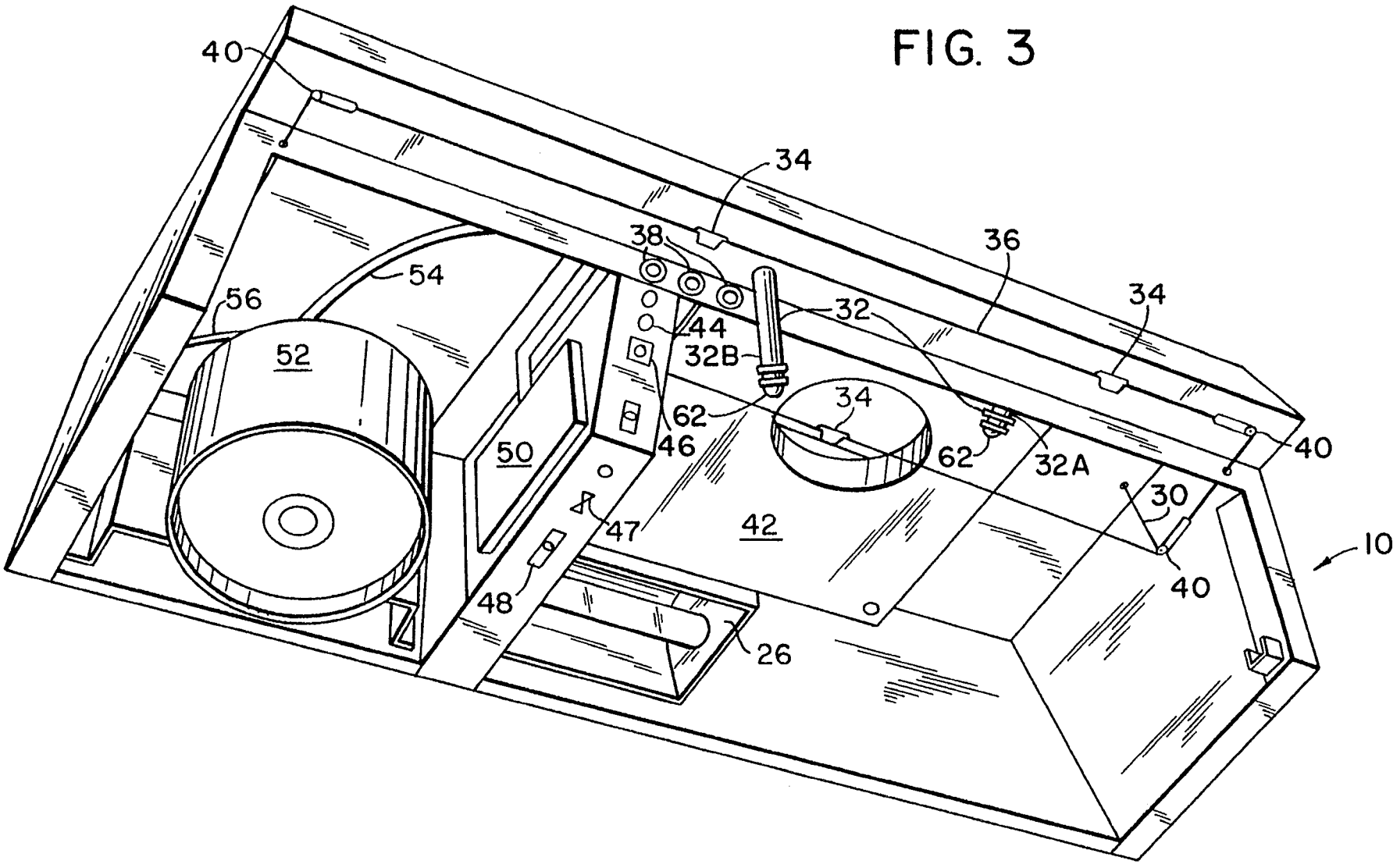
FIG. 3 is a view similar to FIG. 2 but without the hood and from a different angle to expose more of the interior of the system.
Figure 4:
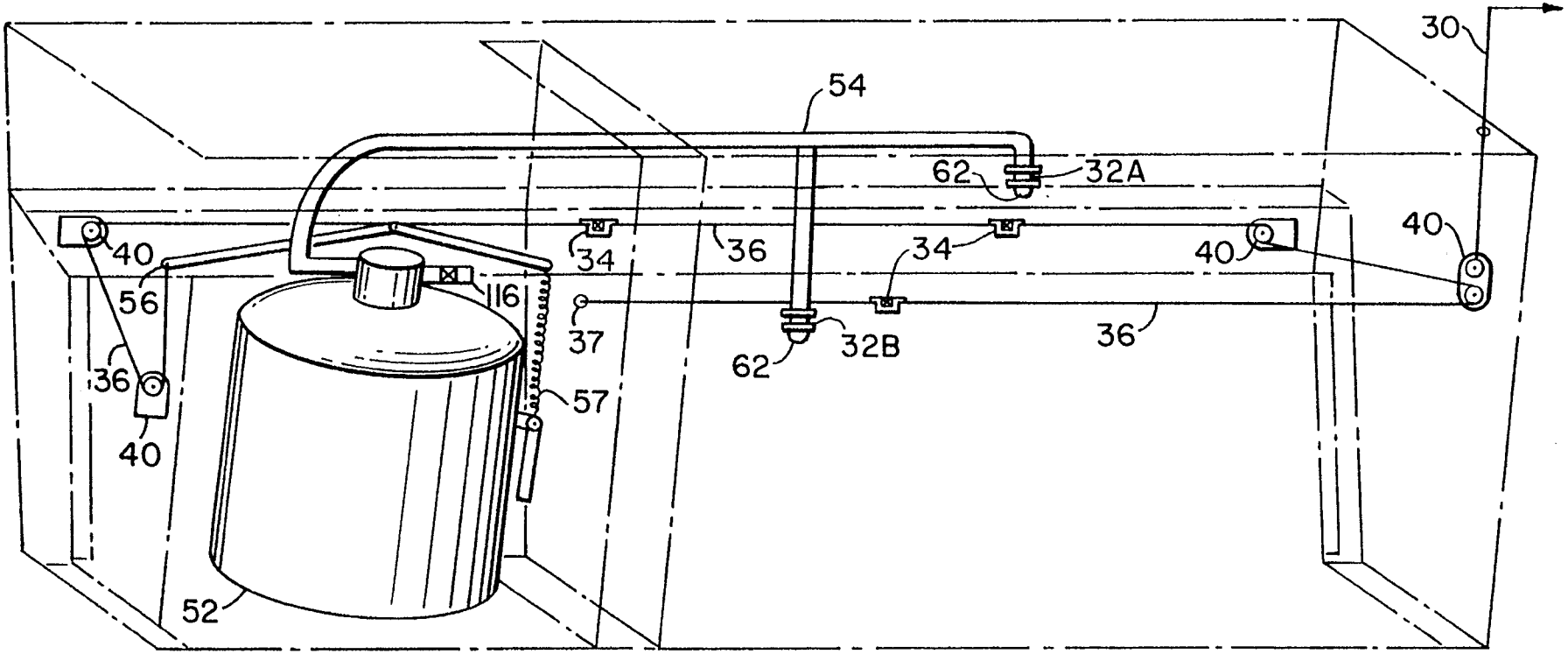
FIG. 4 is a view similar to FIG. 3, but from a different angle to expose more details of one embodiment of the invention.

FIGS. 3 and 4 show the mechanical and hydraulic aspects of the fire retardant system. In particular, hydraulically, tubing 54 is provided to connect the canister 52 to one or more nozzle assemblies 32 (32A and 32B). Mechanically, a cable 36 containing fusible links 34 is connected to a fixed point such as 37, extended along a series of pulleys 40 for the purpose of locating the fusible links at desired locations, and is connected to release valve 56 on canister 52. Release valve 56 is spring loaded by spring 57 so that a break in the tension of cable 36 causes release valve 56 to open. Cable 36 may also provided with a remote cable pull 30 to manually release the fire retardant in canister 52. Because cable 36 is under tension, when a fusible link 34 melts at a predetermined temperature (typically 260° F.), the cable 36 mechanically activates release valve 56, and fire retardant is delivered from canister 52 through tubing 54 to nozzle assembly 32.

Also seen in FIG. 3 is an electrical panel 50 inside the fire control section 12. While panel 50 is shown connected to indicator lamp 44, reset button 46, test switch 47 and emergency bypass switch 48, many other configurations are possible as will be discussed below.

While FIGS. 1–4 show nozzle assembly 32 as including two nozzles (32A and 32B), it is a feature of the invention to provide one or more nozzles strategically arranged. In a preferred embodiment, nozzle assembly 32 comprises two nozzles: one 32A located in the plenum or grease collection area and one 32B located over the stove pointed between burners. The openings in these two nozzles are preferably dimensioned so that 25% of the fire retardant is delivered into the plenum and 75% to the stove top. It is also desirable that the nozzles 32A and 32B be provided with caps 62 to prevent their clogging with grease. Caps 62 should be attached in such a way that the discharge of fire retardant causes them to detach readily. It is also preferred that the nozzles be designed so that droplet and pressure of liquid from them does not cause splashing of grease on the stove top. The nozzles and their caps are discussed in more detail below with reference to FIGS. 5–7.

Canister 52 may contain any known fire retardant under pressure, but the preferred embodiment contains between thirty-one and forty-four ounces of liquid potassium salt solution charged to approximately 195 PSI and regulated to dispense through nozzles 32 at about 60 PSI.

As aforementioned, the fire control section 12 housing canister 52 and electronics panel 50 is ideally enclosed with removable thermal panels 22. This will protect the electrical panel and the canister which supplies the fire retardant from the heat and flames of fire. Thermal panels 22 may be constructed of ½", 2600 degree KAOWOOL furnace blanket insulation encapsulated in 22 gauge sheet metal. The remainder of the system 10 may be housed in 22 gauge stainless steel or other suitable material.

Ideally, the entire system 10 is dimensioned so that it can easily fit inside an existing hood 20. Existing hoods are generally 30" to 42" wide and the system 10 can easily fit in a 30" wide space. In one embodiment of the invention, the fire control section 12 is 9"–12" tall and 9" deep. Obviously, the dimensions of the system 10 can easily be modified. The examples given here are merely to show how the entire system 10 can be designed to fit into an existing hood 20.

As mentioned above, the fire control section 12 contains the electrical components 50 and the supply of fire retardant, canister 52. The other section 14 is provided with an exhaust fan 42 and optionally with a lighting unit 26. The fan 42 may be recirculating or provided with ducts to direct exhaust to a remote location. In either case, a filter 24 is preferably provided with a built-in grease collector. Ideally, filter 24 is removable for cleaning either manually or in a dishwasher.

Figure 5:
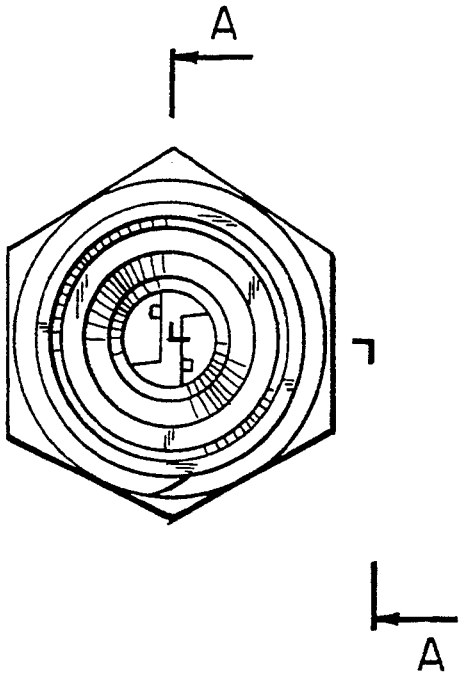
FIG. 5 is an end view of a nozzle used in one embodiment of the invention.
Figure 5A:
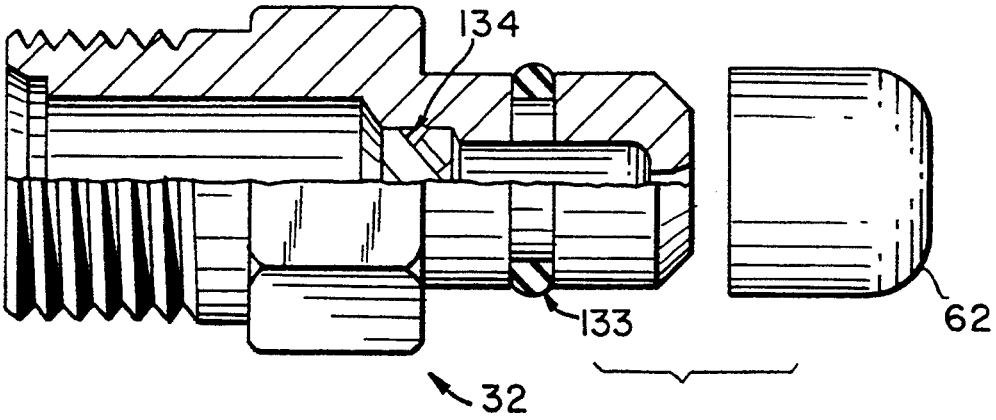
FIG. 5*a* is a side elevational view in partial section along line A—A of FIG. 5 together with a side elevational view of a nozzle cap.

Turning to FIGS. 5 and 5*a*, a side view is seen in partial cross section of a nozzle 32 and a nozzle cap 62. Cap 62 is removably attached to nozzle 32 by means of a biasing O-ring 133 so that cap 62 will pop off when fire retardant is sprayed through the nozzle 32. Nozzle 32 includes a flow regulator 134 which is factory preset to ideally spray between 0.28 and 0.32 gallons per minute at a pressure of about 60 PSI and at a droplet size of approximately 900 microns Sauter mean. In this manner, splashing of grease is minimized, and fires may be easily extinguished.

Figure 6:
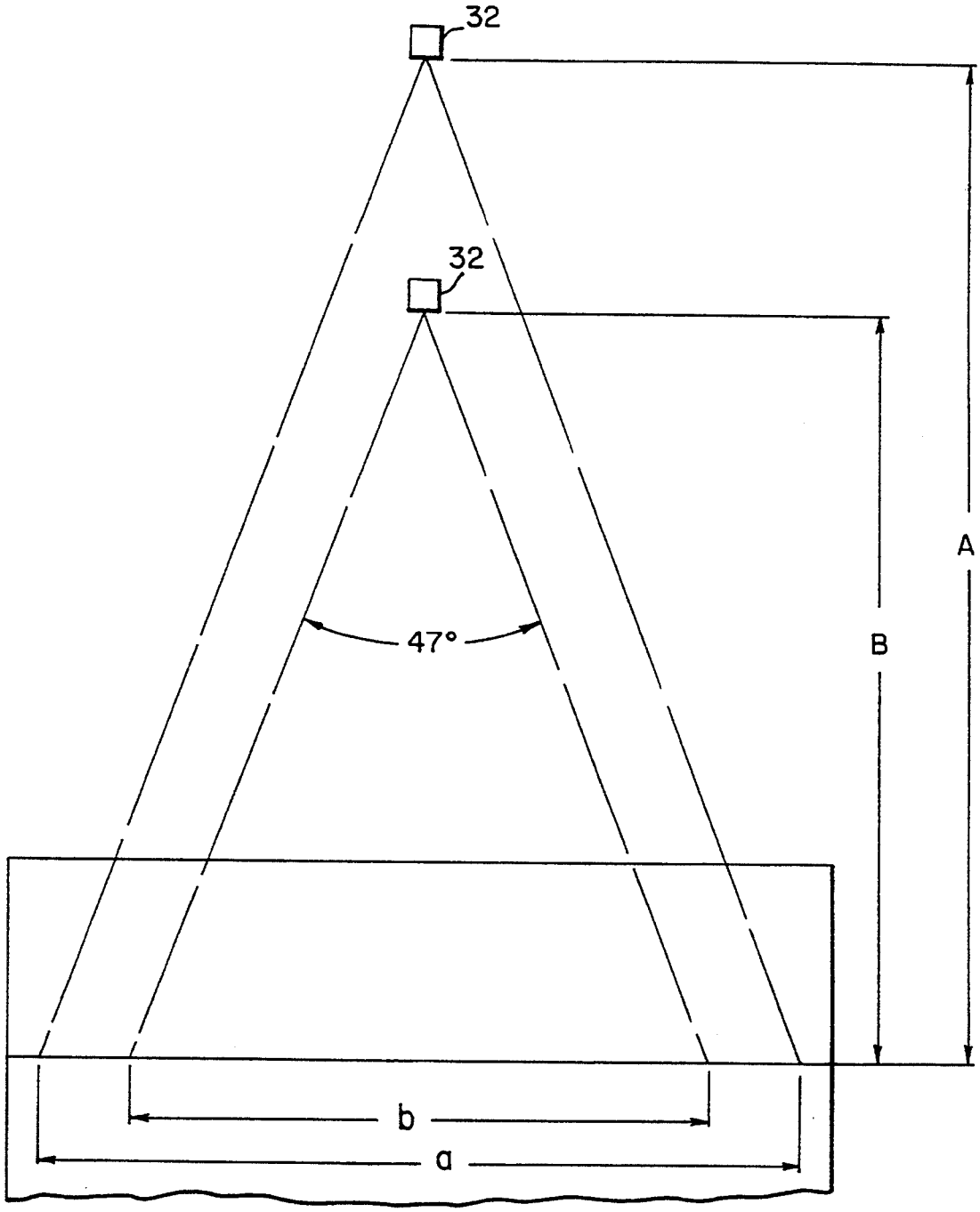
FIG. 6 is a schematic diagram of a side view of spray patterns of nozzles used in one embodiment of the invention.
Figure 7:
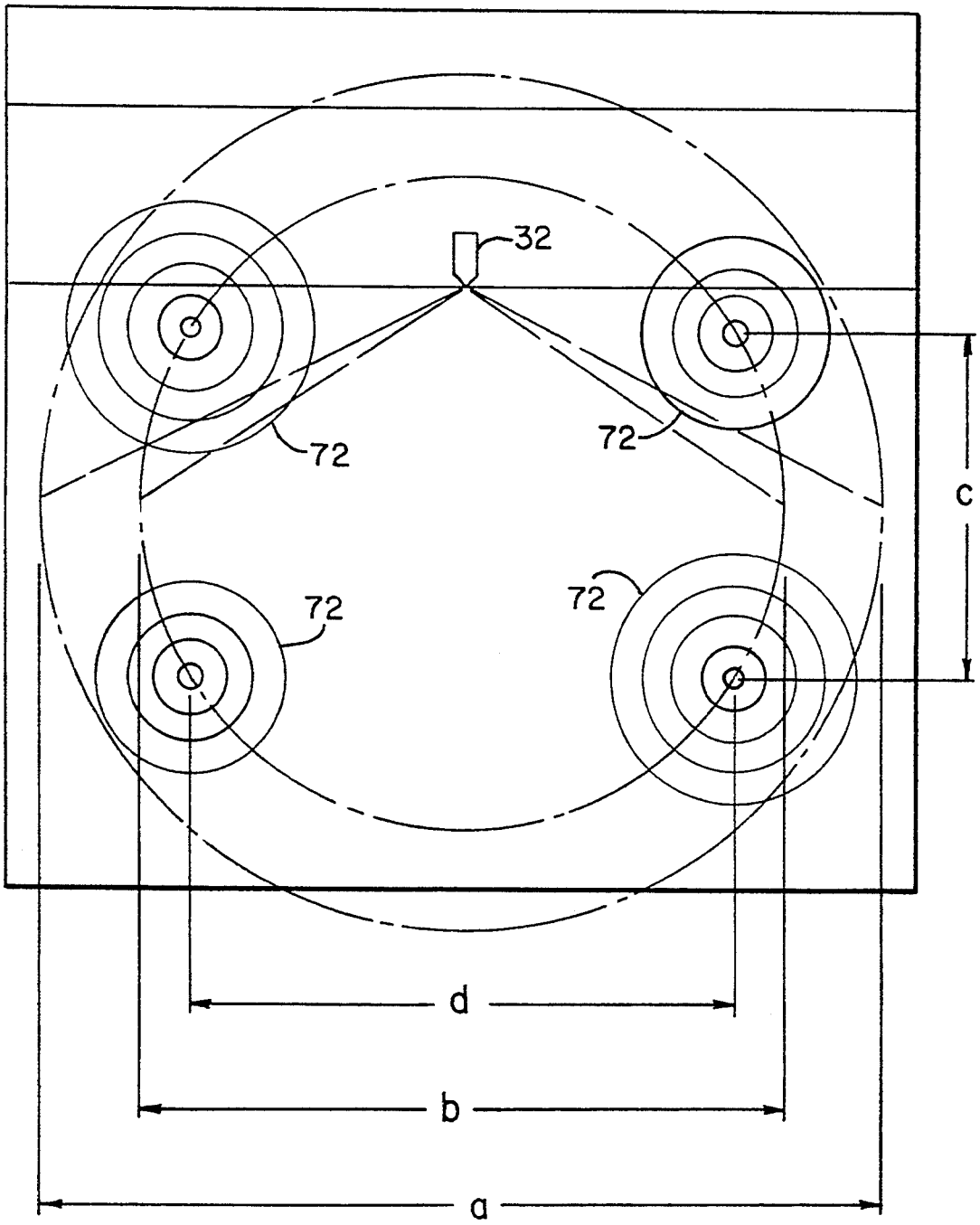
FIG. 7 is a schematic diagram of a plan view of spray patterns of nozzles used in one embodiment of the invention.

FIGS. 6 and 7 are schematic side and plan views of the spray pattern ideally employed by nozzle 32 in a preferred embodiment of the invention. Referring in particular to FIG. 6, where a single nozzle is used over the stove top, the nozzle is preferably designed to spray a full conical pattern with an apex angle of approximately 47°. This angle is useful because, as shown in FIG. 6 and 7, placement of nozzle 32 at a distance A=32" or B=24" from burners 72 will result in a spray coverage diameter of approximately a=28" or b=22", which depending on the type of four burner stove top should be sufficient to cover the same. Clearly, other angles and distances could be used to accommodate other stove tops. Also, it should be appreciated that the plenum nozzle preferably has a spray pattern with a different apex angle (e.g., 60°), as a wider spray is required in the smaller plenum area.

Figure 8:
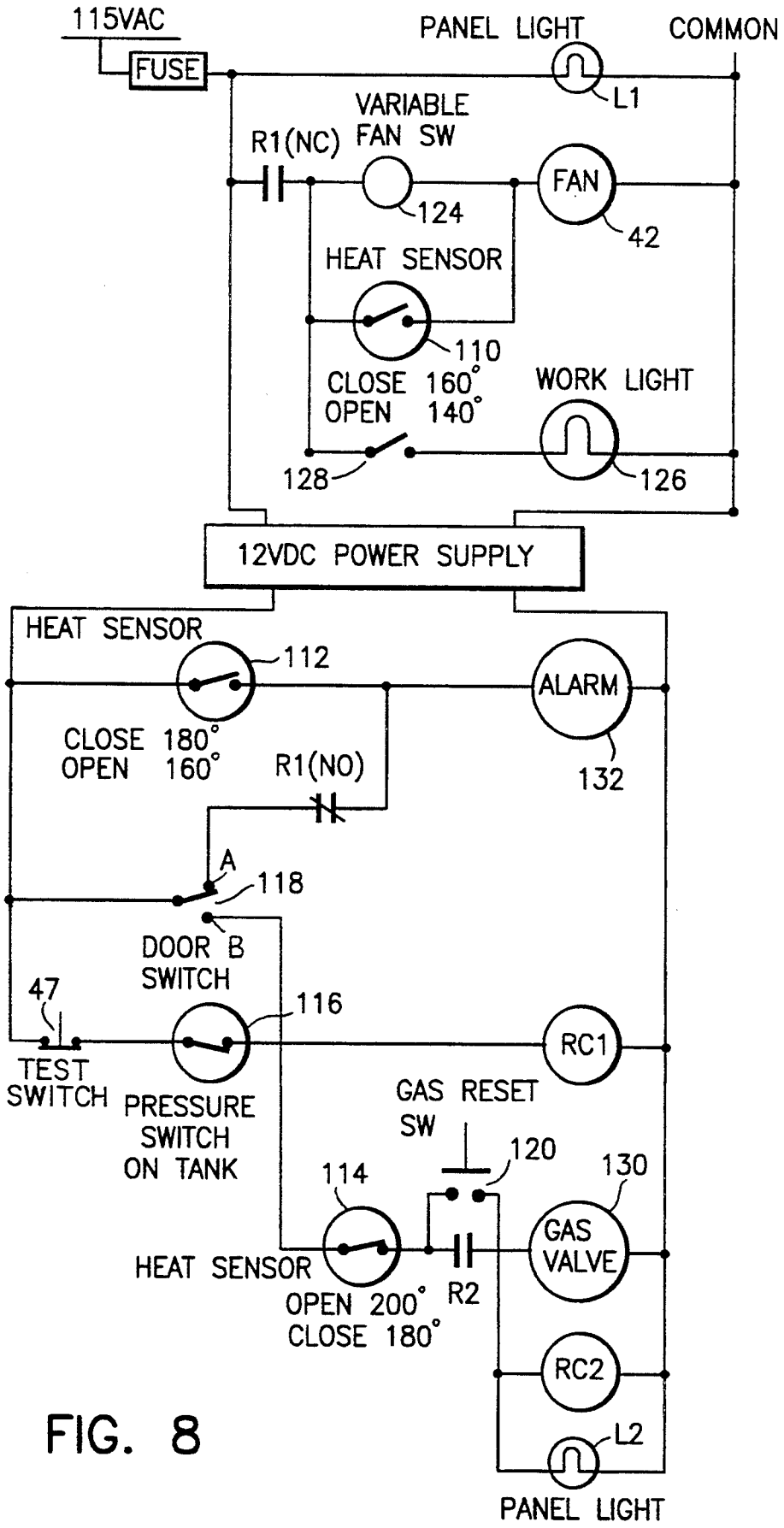
FIG. 8 is a schematic diagram of an exemplary circuit which can be used to operate the system.

FIG. 8 shows one example of how the electrical components of the invention may be arranged to assist in the method of operation of the fire suppression system. The electrical components are best described with reference to the method of operation discussed below.

Figures 9, 9A, 9B:
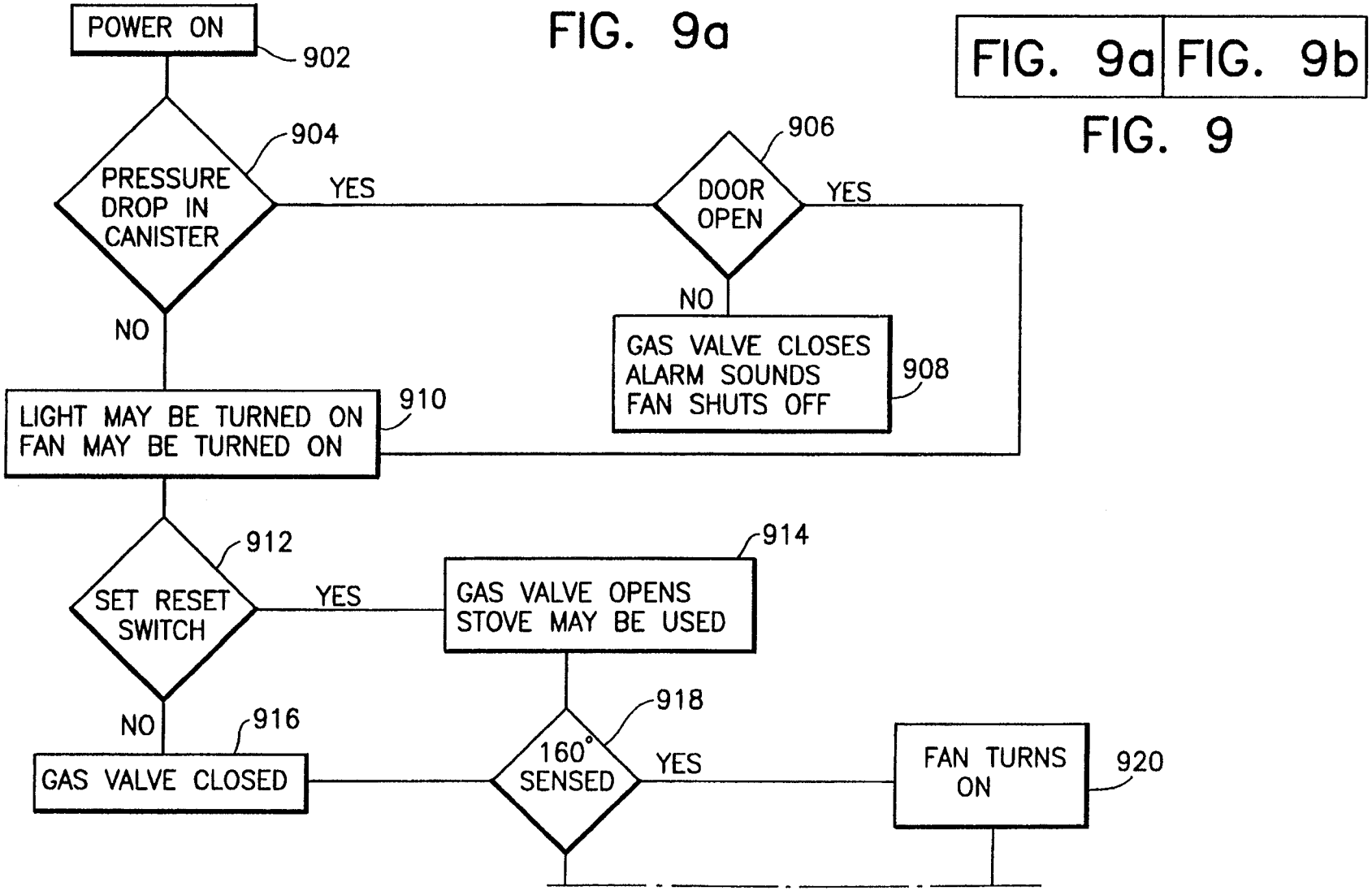
FIG. 9 is a schematic diagram showing the relationship between FIG. 9*a* and FIG. 9*b*.
FIGS. 9*a* and 9*b* together form a flow chart showing the different modes of operation of the preferred system.
Figure 9B:
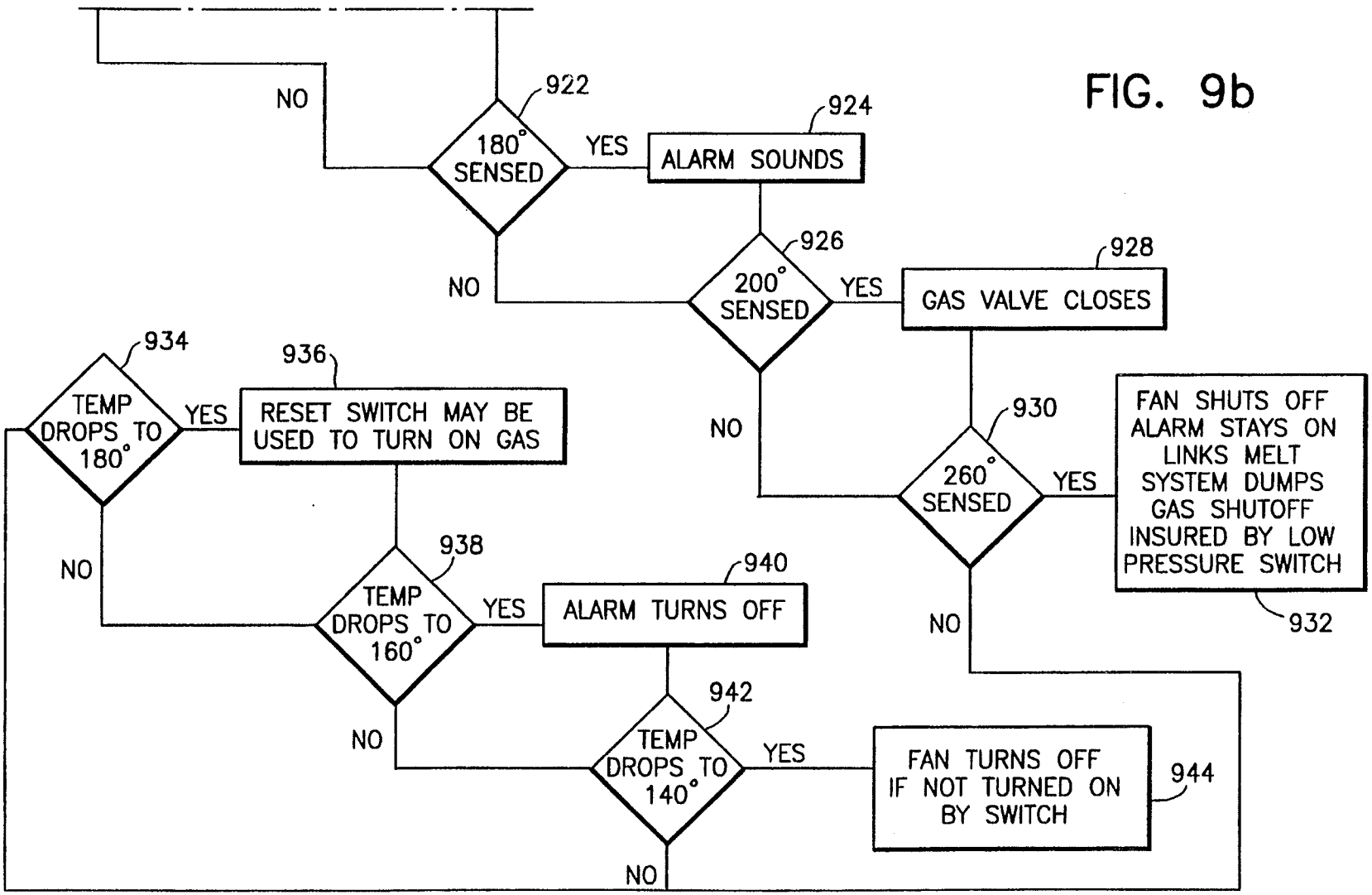

Referring now to FIGS. 8 and 9, the preferred fire suppression system described herein is designed to operate in several modes, and automatically activates and deactivates certain devices (a fan 42, an alarm 132, and a gas valve 130) depending on information obtained from switches and sensors. In the currently preferred embodiment, these switches and sensors include three electronic temperature sensors 110, 112 and 114, a pressure sensor 116, a test switch 47, and a door switch 118. The three electronic temperature sensors are used to control the fan 42, the alarm 132 and the gas valve 130 and are shown schematically as switches which open and close at given temperatures. Clearly, they could be arranged in other ways such as remote sensors with mechanical or electronic relays attached. The pressure sensor 116 (also seen in FIG. 4) is used to detect a drop in pressure in the canister 52, and to sound an alarm in such a situation. The door switch 118 places the system in different modes depending upon whether the bottom assembly 18 (FIGS. 1 and 2) is open or closed. The test switch 47 is used to test the functioning of the system.

In addition to the temperature and pressure sensors, and the test and door switches, a "gas reset" switch 120, a fan switch 124, and a work light 126 with manual switch 128 are also preferably included. The gas reset switch 120 is used to turn on the energy supply to the stove after it has been shut off by one of the sensors. While the circuit described herein makes reference to a gas stove, it is clearly adaptable to use with an electric stove. The fan switch 124 is used to manually activate a fan, if it has not been automatically activated by a temperature sensor, or automatically deactivated due to a fire. The work light 126 may be manually activated by switch 128 and is automatically turned off in the case of fire. It will be appreciated, that, if desired, work light 126 may be arranged to stay on at all times.

In the schematic diagram of FIG. 8, a portion of the circuit is AC powered, and another portion is DC powered as shown. In particular, in the preferred embodiment, the fan 42 and work light 126 are run under AC power, while the alarm 132 and gas valve 130 are run under DC power. Also as shown in FIG. 8, a "AC" panel light L1 is included to show when power is supplied to the circuit, and a "DC" panel light L2 may be included to indicate whether the gas supply has been stopped.

As described in more detail below, the various switches and sensors in different modes, turn the fan on or off, cut power to the work light, activate an alarm, and stop the supply of gas or electricity to the stove to shut the stove down.

Referring now both to the schematic of FIG. 8 and the flow chart of FIGS. 9*a* and 9*b*, it can be seen how the different modes of operation are activated. When power is applied to the circuit at 902, if there is correct pressure in the canister at 904, the light and fan may be manually switched on if desired at 910. However, if there is a pressure drop in the canister, if the door is not open at 906, the alarm 132 is sounded, and the gas valve 130 is shut off at 908. Effectively, then, the user is notified that because of a drop in pressure in the canister 904, the fire suppression system will not function properly, and the stove should not be used. In order to turn off the alarm, the door may be opened at 906. In order to operate the stove, however, gas reset switch 120 must be pressed at 912.

In the schematic of FIG. 8, it can be seen that gas reset switch 120 supplies voltage to relay control RC2 which forces relay R2 into its normally closed position in series with stove shut-off 130 and its normally open position in series with alarm 132. If temperature sensor 114 and pressure sensor 116 are closed (which they will be if the temperature is below 180° F.) and the pressure in canister 52 is above a preset limit, the gas valve 130 will be opened allowing gas to feed into the stove at 914 in FIG. 9*a*. In the case of an electric stove, a relay switch could be substituted for gas valve 130. If the reset switch is not pressed, the gas valve remains closed as shown at 916 in FIG. 9*a*.

If the temperature as sensed by temperature sensor 110 rises to 160° F. as shown at 918 in FIG. 9*a*, temperature sensor 110 closes and turns on the fan 42 (at 920) if it is not already on. This is the first step of the preferred fire suppression method whereby the fan 42 can control the flow of heat towards the sensors thereby allowing better sensing of heat for possible fire conditions as well as providing a mechanism for cooling the cooking area. If despite the turning on of the fan 42, the temperature rises to 180° F. at 922, the temperature sensor 112 closes and turns on the alarm 132 at 924 to warn occupants that a fire or high heat condition exists so they may take manual measures to control it and/or evacuate. If desired, contacts may also be provided to allow for tie-in into existing alarm systems on and/or off premises.

If the temperature rises to 200° F. at 926, temperature sensor 114 opens, thereby closing the gas valve at 928 and also removing voltage from relay control RC2. As a result, the relay control RC2 opens relay R2 so that gas valve 130 stays closed until it is reset as discussed above and below. If the temperature rises to 260° F. as shown at 930 in FIG. 9*b*, which would indicate an uncontrolled fire despite the activation of the previously described provisional measures, the mechanical system described in FIGS. 1–3 operates by fusible links 34 melting as described above, thereby activating the fire extinguisher at 932. As described above, with one nozzle directed toward the cook top, and another located in the plenum, the fire should be extinguished.

It should be appreciated that even if the previously described sensors fail, the pressure sensor 116 will detect the release of fire retardant from canister 52 (brought on by the melting of the fusible links) and will (de)activate relay control RC1. As a result, relay control RC1 closes the normally open relay R1(NO) thereby activating the alarm (if not already activated by sensor 112), and opening the normally closed relay R1(NC), thereby shutting off the fan 42 (in order to avoid the spreading of the fire) and work light 126 (in order to avoid burning in the AC circuit). In addition, the pressure sensor 116 closes the gas valve 130 if not already closed by sensor 114.

On the other hand, if the temperature does not reach 260° F., but begins to drop, additional modes are activated. When the temperature drops to 180° F. at 934, sensor 114 closes and the reset switch 120 may be used to turn the stove back on at 936. When the temperature drops to 160° F. at 938, temperature sensor 112 opens and the alarm turns off at 940. When the temperature drops to 140° F. at 942, temperature sensor 110 opens and fan 42 is shut off at 944 unless it was manually switched on by switch 124.

The pressure switch 116 and door switch 118 effect additional modes of operation. If the pressure in canister 52 drops below a preset limit at 904 in FIG. 9*a*, pressure switch 116 opens and stops the supply of voltage to the relay controls RC1 and RC2, which in turn cause the poles of relays R1 and R2 to cut off power to the fan 42 and the light 126, and which activate the alarm 132 and to shut off power to the stove as shown at 908 in FIG. 9*a*. It should be appreciated that pressure switch 116 will open after the mechanical system triggers a release of fire retardant from canister 52 so that this mode of operation will occur if the temperature reaches 260° F. or if there is a pressure drop in canister 52 regardless of the temperature.

In another mode of operation, when the door switch 118 indicates that the bottom assembly 18 is open (position B on FIG. 8 and 906 in FIG. 9*a*), pressure switch 116 is bypassed. Thus, power is supplied to the fan 42 and light 126, the alarm 132 is not activated by a pressure drop, and gas valve 130 remains open or may be reset by reset switch 120. This mode serves as a bypass to temporarily turn off the alarm if for some reason a pressure drop in canister 52 causes the stove to shut down and the alarm to be activated. It should be appreciated, however, that some warning (e.g., written on the door) should be given to alert the user that this mode of operation should only be used to temporarily turn off the alarm until the unit can be serviced.

The operation of the test switch 47 can be appreciated from the schematic of FIG. 8. The test switch is a normally closed on-off switch and it is located behind the bottom assembly 18 so that the door switch 118 must be in the B (open) position before the test switch is pressed. If the bottom assembly is opened, the test switch 47 is turned to the off position, and the bottom assembly is then closed (switch 118 to position A), the stove (gas valve 130), the light 126 and the fan 42 will shut off and the alarm 132 will sound. If the bottom assembly is then opened (switch 118 to position B), the alarm shuts off, the fan and light are turned back on and the reset switch 120 may be used to restart the stove. Test switch 47 may then be closed and normal operation resumed.

There have been described and illustrated herein fire suppression systems and methods. While particular embodiments of the invention have been described, it is not intended that the invention be limited thereto, as it is intended that the invention be as broad in scope as the art will allow and that the specification be read likewise. Thus, while particular temperatures have been disclosed at which the fan, alarm, energy shut-off, and fire extinguisher are activated, it will be appreciated that other temperatures could be utilized. Also, while particular electrical components and materials have been specified, it will be appreciated that the electrical components may be analog or digital, that suitable mechanical equivalents could be utilized (e.g., for the housing, insulation, etc.). Further, the number, location, and kinds of filters, fans, lights, sensors, alarms, etc. may be changed according to need, and some of the different modes of operation may be eliminated, or different modes of operation added as deemed necessary for a given application, provided that at a minimum, at least one, and preferably two or three provisional remedies are utilized before activating the fire extinguisher. It will therefore be appreciated by those skilled in the art that yet other modifications could be made to the provided invention without deviating from its spirit and scope as so claimed.

I claim:

1. A fire suppression system adapted for use with a stove and contained within a hood over the stove, said system comprising:

a) a nozzle located over said stove;

b) a pressurized supply of fire retardant contained in a pressure vessel connected to said nozzle;

c) activation means for activating release of said fire retardant through said nozzle;

d) a fusible link coupled to said activation means such that when said fusible link melts at a melting temperature, said activation means activates release of said fire retardant through said nozzle;

e) provisional fire control means selected from a group consisting of a fan, an alarm, and a stove shut-off means;

f) a first temperature sensor located above said stove which senses when a first temperature is reached, said first temperature being lower than said melting temperature, said first temperature sensor being coupled to said provisional fire control means such that when said first temperature is reached, said first temperature sensor causes said provisional fire control means to activate; and g) thermal insulation means for establishing a fire enclosure in the hood, said fire safe enclosure said pressure vessel containing said pressurized supply of fire retardant, wherein said fusible link and said first temperature sensor are located outside said fire safe enclosure.

2. A fire suppression system according to claim 1, further comprising:

a pressure sensor means attached to said pressurized supply of fire retardant for sensing that the pressure of said fire retardant has fallen to a predetermined pressure, wherein said provisional fire control means includes said alarm, and said pressure sensor is coupled to said alarm such that when said pressure sensor means senses said predetermined pressure, said pressure sensor causes said alarm to activate.

3. A fire suppression system according to claim 1, further comprising:

a second temperature sensor located above said stove, wherein said second temperature sensor senses when a second temperature has been reached, said second temperature being lower than said melting temperature and higher than said first temperature, and said provisional fire control means comprises at least two of said group consisting of a fan, an alarm, and a stove shut-off means, wherein said first temperature sensor is coupled to a first of said group, and said second temperature sensor is coupled to a second of said group, such that when said first temperature is sensed, said first of said group is activated and when said second temperature is sensed, said second of said group is activated.

4. A fire suppression system according to claim 3, wherein:

said first of said group is said fan, and said fan is located above said stove in a position to draw heat toward said second temperature sensor.

5. A fire suppression system according to claim 4, wherein:

said second of said group is said stove shut-off means.

6. A fire suppression system according to claim 3, further comprising:

a third temperature sensor located above said stove, wherein said third temperature sensor senses when a third temperature has been reached, said third temperature being lower than said melting temperature and higher than said second temperature, and said provisional fire control means comprises all three of said group consisting of a fan, an alarm, and a stove shut-off means, wherein said first temperature sensor is coupled to said fan, said second temperature sensor is coupled to said alarm, and said third temperature sensor is coupled to said stove shut-off means.

7. A fire suppression system according to claim 2, wherein:

said provisional fire control means includes stove shut-off means, and said pressure sensor is coupled to said stove shut-off means such that when said pressure sensor senses said predetermined pressure, said pressure sensor causes said stove shut-off means to activate.

8. A fire suppression system according to claim 7, further comprising:

an override switch coupled to said pressure sensor for deactivating said pressure sensor when said override switch is in a first position.

9. A fire suppression system according to claim 1, where said hood includes a filter and a plenum in said hood behind said filter, further comprising:

a second nozzle connected to said pressurized supply of fire retardant and located in said plenum, wherein said activation means also activates release of said fire retardant through said second nozzle and into said plenum.

10. A fire suppression system according to claim 1, wherein:

said nozzle is adapted to spray droplets of a 900 micron Sauter mean size upon release of said fire retardant through said nozzle.

11. A fire suppression system adapted for use within a hood over a stove, comprising:

a) a nozzle;

b) a pressurized supply of fire retardant connected to said nozzle;

c) activation means for activating release of said fire retardant through said nozzle;

d) an exhaust fan;

e) a fusible link connected to said activation means wherein when said fusible link melts at a melting temperature, said activation means activates release of said fire retardant through said nozzle;

f) circuit means;

g) stove shut-off means; and h) temperature sensing means for sensing ambient temperature over said stove, said temperature sensing means signalling said circuit means upon the sensing of first and second temperatures, said first temperature being lower than said melting temperature, and said second temperature being lower than said melting temperature and higher than said first temperature, wherein said exhaust fan is coupled to said circuit means such that when said first temperature is sensed by said temperature sensing means said exhaust fan is automatically turned on by said circuit means, and said stove shut-off means is coupled to said circuit means such that when said second temperature is sensed by said temperature sensing means, said stove is shut off by said stove shut-off means.

12. A fire suppression system according to claim 11, wherein:

said temperature sensing means comprises means for signalling said circuit means upon the sensing of a third temperature, said third temperature being between said first and second temperatures, and said fire suppression system further comprises an alarm coupled to said circuit means such that when said second temperature is sensed by said temperature sensing means said alarm is activated by said circuit means.

13. A fire suppression system according to claim 11, further comprising:

a pressure sensor attached to said supply of fire retardant and coupled to said circuit means, wherein when said pressure sensor senses a predetermined pressure, said alarm is activated and said stove is shut off.

14. A fire suppression system according to claim 11, further comprising:

thermal insulation means establishing a first insulated enclosed portion in said hood, wherein said pressurized supply of fire retardant, said activation means, and said circuit means are located in said first insulated enclosed portion, and said exhaust fan, said fusible link, said nozzle, and said temperature sensing means are located outside said first insulated enclosed portion.

15. A fire suppression system according to claim 11, further comprising:

stove reset means coupled to said circuit means, wherein said stove can be restarted by said stove reset means when said ambient temperature is at or below said second temperature as measured by said temperature sensing means.

16. A fire suppression system according to claim 11, further comprising:

a removable filter means attached to said hood outside said first insulated enclosed portion; and a second nozzle means connected to said pressurized supply of fire retardant, wherein said second nozzle and said exhaust fan are located in said hood in a second portion behind said removable filter means relative to said stove.

17. A fire suppression system according to claim 11, further comprising:

a detachable cap attached to said nozzle and covering openings in said nozzle through which said fire retardant is sprayed, said detachable cap automatically detaching when said fire retardant is released through said nozzle.

18. A fire suppression system according to claim 13, further comprising:

thermal insulation means establishing a first insulated enclosed portion in said hood, wherein said pressurized supply of fire retardant, said activation means, and said circuit means are located in said first insulated enclosed portion, and said exhaust fan, said fusible link, said nozzle, and said temperature sensing means are located outside said first insulated enclosed portion; and a door connected to said first insulated enclosed portion in said hood, said door having a door switch coupled to said circuit means, wherein said door switch signals said circuit means when said door is open, and when said door is open, said circuit means overrides said alarm and stove shut off.

19. A method of operating a stove fire suppression system having within a hood a temperature sensing means, a fan means, a pressurized supply of fire retardant, and at least one of a stove shut-off activation means and an alarm activation means, the method comprising the steps of:

a) monitoring ambient temperature above said stove with said temperature sensing means;

b) upon sensing a first high temperature with said temperature sensing means, activating said fan means;

c) upon sensing a second temperature higher than said first temperature with said temperature sensing means, activating said at least one of said alarm activation means and said stove shut-off activation means;

d) upon sensing a third temperature higher than said second temperature, dispensing said pressurized supply of fire retardant on the stove.

20. A method according to claim 19, wherein said stove fire suppression system has both said stove shut-off activation means and said alarm activation means, said method further comprising:

e) upon sensing a third temperature between said first and second temperatures, activating said alarm activation means to turn on said alarm, wherein step c) comprises activating said stove shut-off activation means to shut off said stove.

21. A method according to claim 20, wherein said stove fire suppression system further includes a pressure sensing means for sensing the pressure of said pressurized supply of fire retardant, said method further comprising:

monitoring the pressure of said pressurized supply of fire retardant; and upon sensing a predetermined pressure, signalling said alarm activation means and said stove shut-off activation means to turn on said alarm and shut off said stove.

* * * * *